US010176822B2

(12) United States Patent
Brunton

(10) Patent No.: US 10,176,822 B2
(45) Date of Patent: Jan. 8, 2019

(54) SYSTEM AND METHOD FOR AUDITING AND FILTERING DIGITAL AUDIO FILES

(71) Applicant: Cymatrax, Dallas, TX (US)

(72) Inventor: Alan Brunton, Lewisville, TX (US)

( * ) Notice: Subject to any disclaimer, the term of this patent is extended or adjusted under 35 U.S.C. 154(b) by 0 days.

(21) Appl. No.: 15/665,356

(22) Filed: Jul. 31, 2017

(65) Prior Publication Data

US 2018/0061430 A1 Mar. 1, 2018

Related U.S. Application Data

(60) Provisional application No. 62/382,243, filed on Aug. 31, 2016.

(51) Int. Cl.

| | |
|---|---|
| ***G10L 21/02*** | (2013.01) |
| ***G10L 21/007*** | (2013.01) |
| ***G10L 21/0232*** | (2013.01) |
| ***G10L 21/0364*** | (2013.01) |

(52) U.S. Cl.
CPC ..... *G10L 21/0205* (2013.01); *G10L 21/007* (2013.01); *G10L 21/0232* (2013.01); *G10L 21/0364* (2013.01)

(58) Field of Classification Search
CPC ..... G10L 21/0205; G10L 21/007; G10L 21/0232; G10L 21/0364
USPC ..... 381/99
See application file for complete search history.

(56) References Cited

U.S. PATENT DOCUMENTS

2015/0179161 A1* 6/2015 Fujiwara ..... G10K 15/04 381/98

OTHER PUBLICATIONS

Anblicks, "Anblicks Software & Consulting Services," http://www.anblicks.com, printed on Oct. 19, 2017, 1 page.

(Continued)

*Primary Examiner* — Vivian Chin
*Assistant Examiner* — Douglas Suthers
(74) *Attorney, Agent, or Firm* — Wei Wei Jeang; Grable Martin Fulton PLLC

(57) ABSTRACT

A computerized method for filtering a digital audio file to generate an output audio file that induces optimal health and cognitive ability in a listener of a playback of the output audio file is described herein. The method includes the steps of identifying a plurality of target frequencies that span within an octave, identifying a plurality of mid-point frequencies that are situated at mid-points between any two adjacent target frequencies, applying a peaking filter to the digital audio file centered around the plurality of mid-point frequencies to produce highest frequency attenuation at the plurality of mid-point frequencies, and generating the output audio file.

16 Claims, 4 Drawing Sheets

(56) References Cited

OTHER PUBLICATIONS

Goldman, Jonathan, "Sound and the Chakras," http://www.healingsounds.com/sound-and-the-chakras, printed on Oct. 19, 2017, 5 pages.
Smith, Jane Ma'ati, "Chakra Balancing Music and Sound Healing for Your Well Being," http://balance.chakrahealingsounds.com/1st-chakra/, printed on Oct. 19, 2017, 4 pages.
Wikipedia, "Cymatics," https://en.wikipedia.org/wiki/Cymatic, printed on Oct. 19, 2017, 3 pages.
Wikipedia, "Epigenetics," https://en.wikipedia.org/wiki/Epigenetics, printed on Oct. 19, 2017, 15 pages.
Wikipedia, "Signal transduction," https://en.wikipedia.org/wiki/Signal_transduction, printed on Oct. 19, 2017, 9 pages.

* cited by examiner

SYSTEM AND METHOD FOR AUDITING AND FILTERING DIGITAL AUDIO FILES

RELATED APPLICATION

This patent application claims the benefit of U.S. Provisional Patent Application No. 62/382,243 filed on Aug. 31, 2016.

FIELD

The present disclosure relates to the field of audio signal processing, and in particular a system and method for auditing and filtering digital audio files to generate an output audio file that when played back, may induce optimal health and cognitive ability in the listener.

BACKGROUND

Pythagoras is credited for defining a mathematical equation back in 570-495 BC which gives the understanding that frequency specific vibration is not limited to an eight-note octave. Up to the 12th and 13th centuries, musicians were allowed to find and use frequencies which individually targeted vibrational connections with the human body. But in the $13^{th}$ and 14th centuries, the Roman Catholic Church started to mandate which frequencies could and could not be used in music composition.

Around 1888, the great opera composer, Giuseppe Verdi, mandated that all symphony orchestras would tune Concert A to 432 Hz. It was late believed (evidence not proven) that scientists went to Adolph Hitler in and around 1937, telling him that if orchestras would tune to 440 Hz instead of 432 Hz, that the listening audience would be more susceptible to subliminal directions. This was in turn given to Joseph Gerble, the propaganda manager of the 3rd Reicht to implement into ever city's orchestra under control of the Reicht.

After WWII, the International Standards Organization (ISO) mandated that concert A for all music be at 440 Hz and has not been changed and rarely questioned. It has only been since Hans Jenny (1904-1972) https://en.wikipedia.org/wiki/Cymatics defined a new term CYMATICS which filmed studies have taken place to understand how energy moves through matter. Modulating frequencies is seen through the simple design of laying a stereo speaker on its back, placing a flat metal plate on top of the speaker, pouring fine sand on top and then turning on an amplifier and frequency generator. As the frequency is modulated up or down, it is only on specific frequencies do we find that the sand forms specific geometric patterns. As the frequencies continue to modulate, the sand dissolves from the patter, back into a blob and then into another geometric pattern. These patterns show frequencies which energy moves through matter. Over the past 8-10 years, we now have new scientific studies of epigenetics https://en.wikipedia.org/wiki/Epigenetics and from here is the application of understanding signal transduction https://en.wikipedia.org/wiki/Signal_transduction

DETAILED DESCRIPTION

Figure 1:
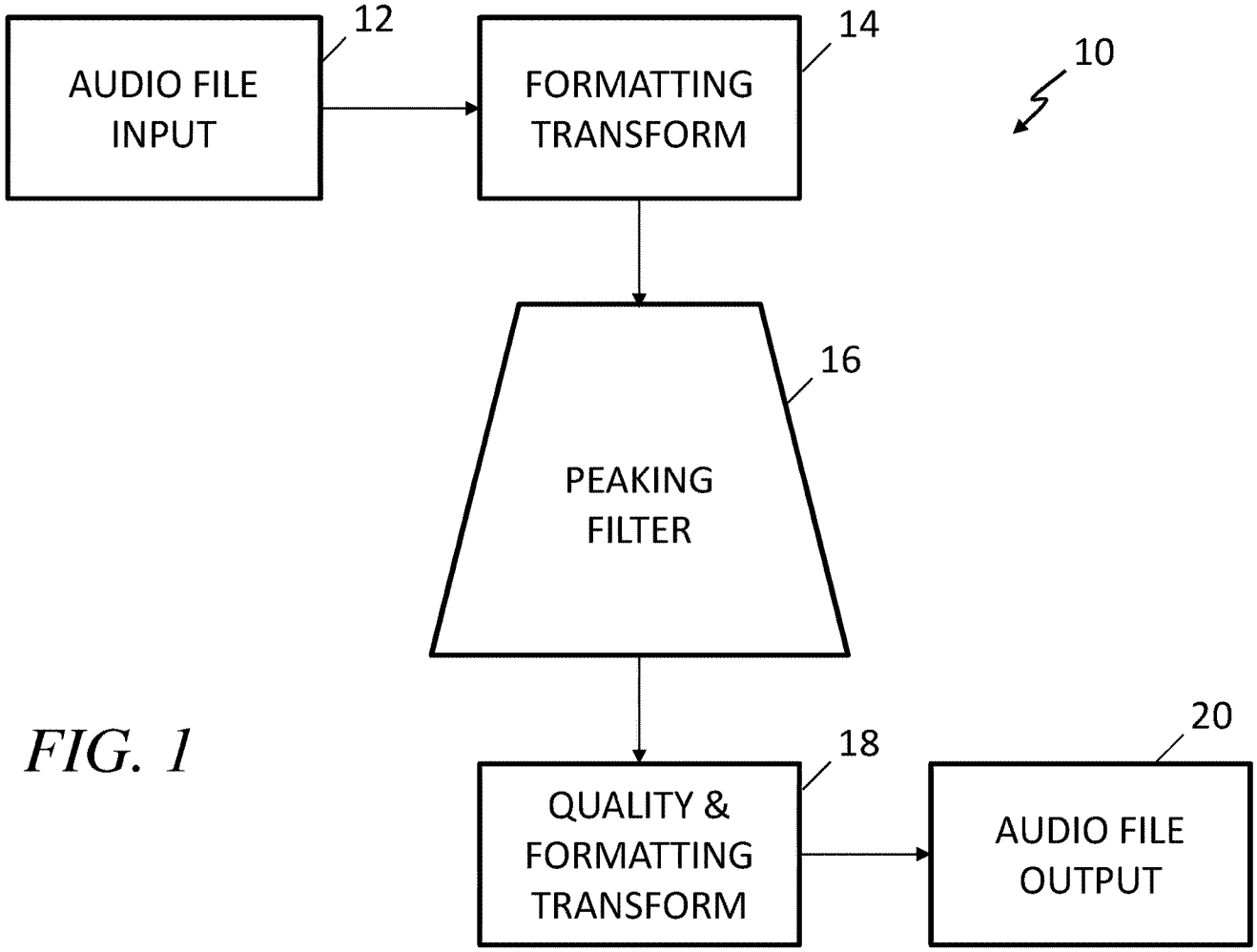
FIG. 1 is a simplified flowchart of an exemplary embodiment of the method for auditing and filtering digital music files according to the teachings of the present disclosure.

FIG. 1 is a simplified flowchart of an exemplary embodiment of the method 10 for auditing and filtering music files according to the teachings of the present disclosure. The method 10 accesses a digital audio file 12 stored in memory, which is preferably a digital music recording but can be an audio file of any type and format. If the audio file is in an analog format, then a conversion step is used to convert it to a desired digital file format. The digital audio file may be pre-processed to convert its file format from an original format into a desired format and any other pre-processing step that is necessary, as shown in block 14. Then the digital audio file is processed by a set of peaking filters 16, which produce attenuation at a certain number of center frequencies in the audio signal. Thereafter, final output formatting and rendering is done in block 18, such as to set resolution of the output sound file and maintain the fidelity of the audio file output 20.

A primary goal of the system and method described herein is to decrease stress and increase cognitive ability in anyone who listens to recorded music or any audio recording. The method herein identifies the frequencies that may be detrimental to the optimal health and cognitive abilities of the user and reduces those frequencies by a predetermined percentage. The resultant output music/audio file, when played back, contributes to optimal mental and physical health and wellbeing of the listener.

Figure 2:
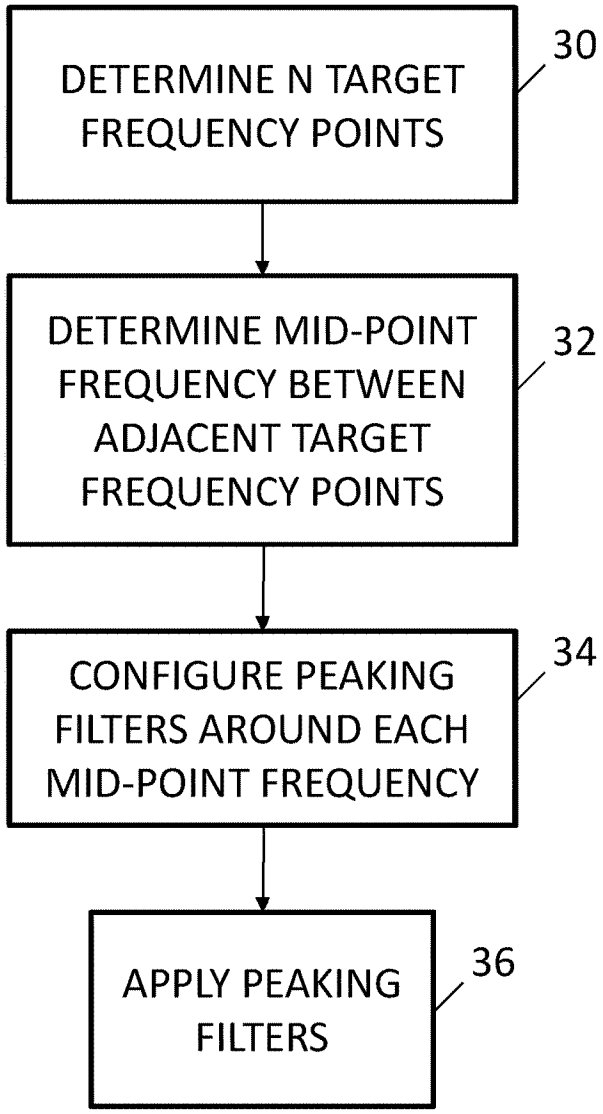
FIG. 2 is a more detailed flowchart of an exemplary embodiment of the method for determining peaking filter parameters according to the teachings of the present disclosure.
Figure 3:
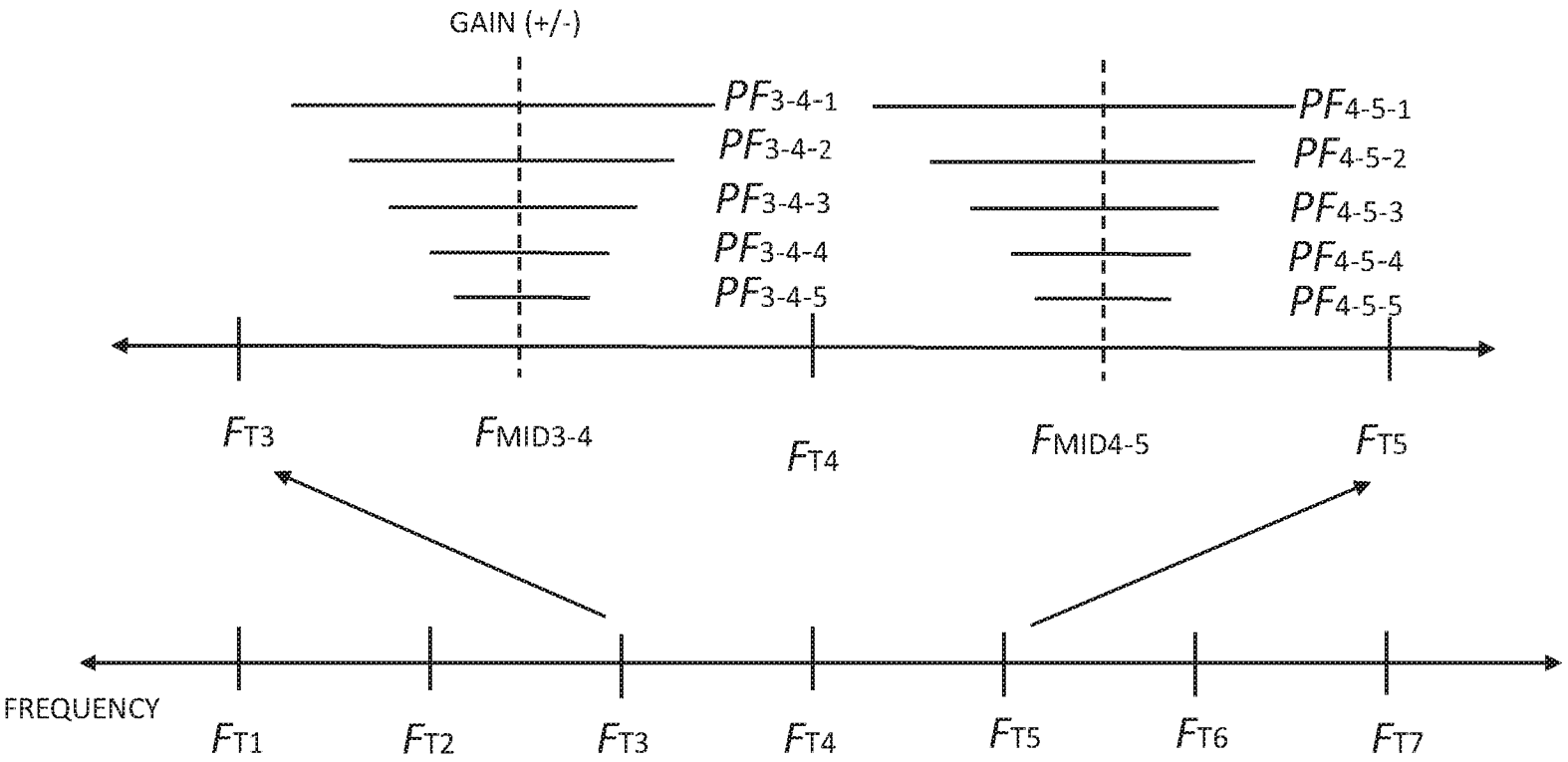
FIG. 3 is a simplified frequency spectrum illustration of an exemplary embodiment of the method of auditing and filtering digital music files according to the teachings of the present disclosure.

FIG. 2 is a more detailed flowchart of an exemplary embodiment of the method for determining peaking filter parameters according to the teachings of the present disclosure. Referring also to FIG. 3 for a simplified frequency spectrum illustration according to the teachings of the present disclosure. In a preferred embodiment, seven frequencies, FT1-FT7, in the audio file are targeted, as shown in block 30 (FIG. 2). The determination of seven specific target frequencies is due to the understanding of classical music composition. There are eight notes or an octave in a musical scale. The seven target frequencies are preferably chosen in the mid-range of most recorded music. Alternatively, the target frequencies may be chosen dynamically for the specific audio recording to be processed. More specifically, the target frequencies characteristics span an octave and are at least one semitone apart. It should be noted that the method may employ more or fewer number of target frequencies. For example, in an alternate embodiment, the method may add or double (or tripling, quadrupling, etc.) the primary seven target frequencies into higher and lower octaves. For example, in pop music the main spectrum of frequencies is between 200 Hz and 800 Hz. The target frequencies may be in multiple octaves, lower, like a double bass in a symphony orchestra and higher, as in the highest notes of a first violin.

It should be noted that an implementation of the method described herein may use any number of target frequencies, and may even dynamically change the target frequencies and the number thereof depending on a number of factors, such as characteristics of the music/audio file, preferences and/or needs of the user/listener, and/or the processing power of the computing device executing the method/software. In an alternate embodiment, the number of target frequencies may be an input received from the user/listener.

In a preferred embodiment, the six mid-point frequencies of the seven target frequencies are subjected to attenuation to remove frequencies that may be disruptive to the human body's energy centers and channels. The method identifies or determines the mid-point frequency for each pair of adjacent target frequencies, as shown in block 32. For example, between target frequencies $F_{T3}$ and $F_{T4}$ shown in FIG. 3, the frequency at their mid-point, $F_{MID3\text{-}4}$, is determined. So for seven target frequencies, six mid-point frequencies are identified or determined. It should be noted that the distance or bandwidth between the pairs of adjacent target frequencies may or may not be the same among the set of target frequencies. Once the mid-point frequencies are identified, then the method configures peaking filters around each mid-point frequency and filters the sound file, as shown in blocks 34 and 36. In essence, the peaking filters are applied to filter the frequencies outside of the target frequencies in the audio file.

More specifically, the peaking filters are arranged so that the mid-point frequencies in the audio file are subjected to the most attenuation or loss, while frequencies further away from the mid-point frequencies and closer to the target frequencies experience less loss. In a preferred embodiment, five iterations of peaking filters of different bandwidths centered about each mid-point frequency are applied to the digital audio file. For example as shown in FIG. 3, for mid-point frequency $F_{MID3\text{-}4}$, peaking filters $PF_{3\text{-}4\text{-}1}$-$PF_{3\text{-}4\text{-}5}$, are applied. Accordingly, the digital audio file is selectively filtered to provide the greatest attenuation or loss at the mid-point frequencies. The parameters of the peaking filters for a mid-point frequency may be determined depending on the target frequencies and mid-point frequency.

For example, the mid-point frequency between two target frequencies may be filtered at the highest attenuation, e.g., 5%. At frequencies on its either sides along the frequency spectrum may be filtered to produce 4% attenuation. At frequencies further away from the mid-point frequency may be filtered 3%, 2%, and 1%, for example. In a preferred embodiment, the user may decide and dial in the amount of filtering (e.g., highest percentage higher or lower than 5%) he/she desires dynamically to produce the desired output.

To all or most listeners, the audio output produced by the filtering process described herein is not readily apparent or detectable. The quality and fidelity of the music/audio recording remains essentially the same after the filtering process. However, the gain of those frequencies that are in conflict with or disruptive to the natural energy flow and energy centers of the human body are lessened by the peaking filtering method described herein.

It should be noted that in a preferred embodiment, the seven target frequencies, the mid-point frequencies, and the configuration of the peaking filters are all pre-determined and ready to be used to analyze and process the audio file. Where any parameter is dynamically set to other settings, depending on user preference, characteristics of the audio file, and other factors, then these frequencies and other settings may be calculated on the fly.

Figure 4:
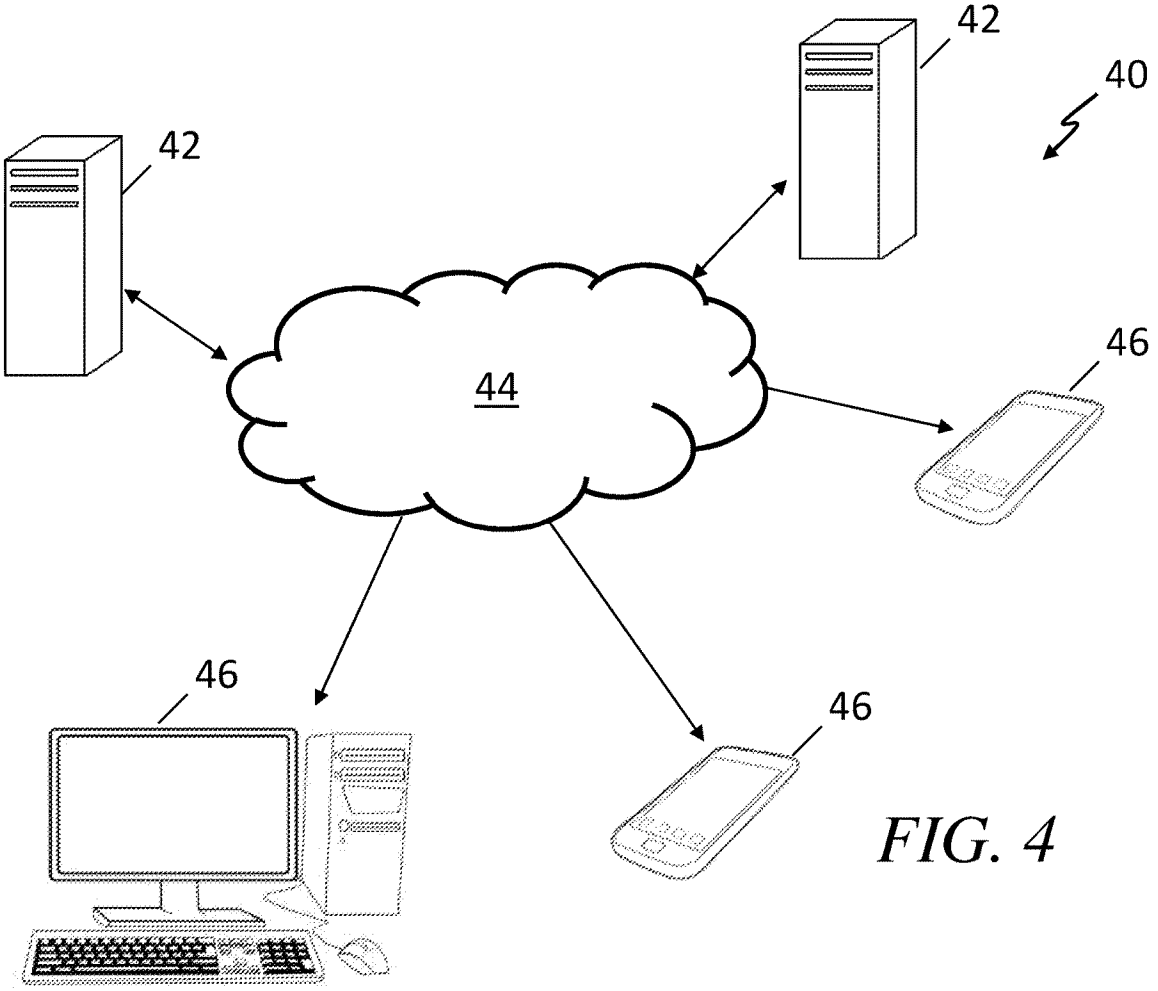
FIG. 4 is a simplified block diagram of the operating environment of the system and method for auditing and filtering digital music files according to the teachings of the present disclosure.

FIG. 4 is a simplified block diagram of the operating environment 40 of the system and method for auditing and filtering digital audio files according to the teachings of the present disclosure. The recorded digital music or audio file may be stored in one or more servers 42 accessible via the Internet 44. These servers 42 may be configured to execute software instructions that perform the method described herein on the stored music or audio files for streaming or downloading to user devices 46 via the Internet 44. For example, the servers 42 may store original music files as well as filtered music files and enable the user to selectively stream one or the other. Alternatively, the filtering software may be downloaded and installed in a number of different types of Internet-connected user devices 46, such as mobile phones, tablet computers, laptop computers, desktop computers, appliances, wearable devices, and devices having a myriad of other form factors. These devices 46 may download and store original music or audio files in memory. The filtering software may reside on these user devices 46, which execute the software to perform digital audio file filtering and play the resulting (stored or not stored) output for the user's listener pleasure. Alternatively, these devices 46 may stream filtered digital audio files via the Internet (using wired or wireless connections over any suitable communication protocol) 44 from one or more servers 42.

The features of the present invention which are believed to be novel are set forth below with particularity in the appended claims. However, modifications, variations, and changes to the exemplary embodiments described above will be apparent to those skilled in the art, and the system and method for auditing and filtering digital audio files described herein thus encompasses such modifications, variations, and changes and are not limited to the specific embodiments described herein.

What is claimed is:

1. A computerized method for filtering a digital audio file to generate an output audio file that induces improved health and cognitive ability in a listener of a playback of the output audio file, comprising:

identifying a plurality of target frequencies that span at least one octave;

identifying a plurality of mid-point frequencies that are situated at mid-points between any two adjacent target frequencies;

applying a set of peaking filters to the digital audio file centered around the plurality of mid-point frequencies to produce highest frequency attenuation at the plurality of mid-point frequencies and generating a filtered digital audio file;

generating the output audio file based on the filtered digital audio file; and playing back the generated output audio file to the listener to induce improved health and cognitive ability in the listener.

2. The computerized method of claim 1, wherein identifying a plurality of target frequencies comprises identifying a plurality of target frequencies that span more than one octave.

3. The computerized method of claim 1, wherein identifying a plurality of target frequencies comprises receiving a user input indicative of a number of target frequencies to be identified.

4. The computerized method of claim 1, wherein identifying a plurality of target frequencies comprises identifying seven target frequencies.

5. The computerized method of claim 1, wherein applying a set of peaking filters comprises applying five peaking filters of different bandwidths centered about each mid-point frequency.

6. The computerized method of claim 1, further comprising transmitting and streaming the output audio file to a user device over a global computer network.

7. The computerized method of claim 1, further comprising receiving a selection of a digital audio file from a user.

8. The computerized method of claim 1, receiving the digital audio file selection as input.

9. A computerized method, comprising:

receiving a selection of a digital audio file from a user;

receiving the digital audio file selection as input;

receiving user preferences on filtering parameters;

configuring and applying a set of peaking filters in response to the user filtering parameter preferences to the digital audio file selection centered around a plurality of mid-point frequencies at mid-points between any two adjacent target frequencies of a plurality of target frequencies, to produce highest frequency attenuation at the plurality of mid-point frequencies and generating a filtered digital audio file, where the plurality of target frequencies span at least one octave;

generating an output audio file based on the filtered digital audio file; and transmitting and streaming the output audio file to a user device via a global computer network, and enabling playback of the transmitted output audio file to the listener to induce improved health and cognitive ability in the listener.

10. The computerized method of claim 9, further comprising identifying a plurality of target frequencies that span more than one octave.

11. The computerized method of claim 9, further comprising identifying seven target frequencies.

12. A non-transitory computer-readable medium having encoded thereon when executed by a computer performs a plurality of steps of a method comprising:

receiving a selection of a digital audio file from a user;

accessing the digital audio file selection as input from a storage device;

configuring and applying a set of peaking filters to the digital audio file selection centered around a plurality of mid-point frequencies defined as mid-points between any two adjacent target frequencies of a plurality of target frequencies, to produce highest frequency attenuation at the plurality of mid-point frequencies and generating a filtered digital audio file, where the plurality of target frequencies span at least one octave; and generating an output audio file based on the filtered digital audio file; and enabling playback of the generated output audio file to the user to induce improved health and cognitive ability in the listener.

13. The method of claim 12, further comprising transmitting and streaming the output audio file to a user device via a global computer network.

14. The method of claim 12, further comprising receiving user preferences on peaking filtering parameters, including target frequencies and an amount of attenuation at mid-point frequencies, and applying the set of peaking filters in response to the user filtering parameter preferences.

15. The method of claim 12, further comprising playing the output audio file to the user.

16. The method of claim 12, further comprising identifying a plurality of target frequencies that span within an octave, identifying a plurality of mid-point frequencies that are situated at mid-points between any two adjacent target frequencies, and applying the set of peaking filters in response to the identified mid-point frequencies.

* * * * *